US009325130B2

(12) United States Patent
Lombardo

(10) Patent No.: US 9,325,130 B2
(45) Date of Patent: Apr. 26, 2016

(54) DISTRIBUTOR HAVING A POWER CONNECTION WITH A PLUG

(76) Inventor: Paolo Lombardo, Eugendorf (AT)

( * ) Notice: Subject to any disclaimer, the term of this patent is extended or adjusted under 35 U.S.C. 154(b) by 213 days.

(21) Appl. No.: 14/119,943

(22) PCT Filed: May 16, 2012

(86) PCT No.: PCT/AT2012/050073
§ 371 (c)(1),
(2), (4) Date: Dec. 5, 2013

(87) PCT Pub. No.: WO2012/159144
PCT Pub. Date: Nov. 29, 2012

(65) Prior Publication Data

US 2014/0120765 A1 May 1, 2014

(30) Foreign Application Priority Data

May 26, 2011 (AT) ..... GM305-2011

(51) Int. Cl.
*H01R 13/72* (2006.01)
*H01R 25/00* (2006.01)
*H01R 9/24* (2006.01)
*H01R 13/514* (2006.01)

(52) U.S. Cl.
CPC ..... *H01R 25/003* (2013.01); *H01R 9/2408* (2013.01); *H01R 13/514* (2013.01); *H01R 13/72* (2013.01)

(58) Field of Classification Search
CPC ..... H01R 13/72
USPC ..... 439/501
See application file for complete search history.

(56) References Cited

U.S. PATENT DOCUMENTS 3,691,510 A * 9/1972 Lehmann ..... H01R 4/5008 174/69
3,786,312 A * 1/1974 Roussard ..... H02B 1/52 307/112
4,713,497 A * 12/1987 Smith ..... H02G 11/02 191/12.2 R
5,334,033 A * 8/1994 Milan ..... H01R 13/6666 439/214
5,518,417 A * 5/1996 Liu ..... H01R 13/72 242/379
5,593,316 A * 1/1997 Lyons ..... H01R 13/72 439/501
5,669,571 A * 9/1997 Graybill ..... B65H 75/44 242/378.1
5,690,198 A * 11/1997 Lohr ..... H02G 11/02 191/12.2 R
5,723,815 A * 3/1998 Pena ..... H02G 11/02 174/135
5,885,109 A * 3/1999 Lee ..... H01R 13/514 439/131
6,573,617 B2 * 6/2003 Jones ..... H01R 13/514 307/11

(Continued)

FOREIGN PATENT DOCUMENTS

DE 100 37 179 A1 11/2002

OTHER PUBLICATIONS

International Search Report of PCT/AT2012/050073, mailed Feb. 14, 2013.

(Continued)

*Primary Examiner* — Neil Abrams
(74) *Attorney, Agent, or Firm* — Collard & Roe, P.C.

(57) ABSTRACT

A distributor is proposed, comprising a power connection having a plug (1) and being connected to at least two socket connectors (3) via an electric conductor (2). In order to provide the highest level of variability concerning the extension length it is proposed that the socket connectors (3) are associated with separate sockets (4) which can be detachably interconnected or detachably connected to a housing (6) and which are each connected one to the other or to the housing (6) by an extension lead (5).

7 Claims, 7 Drawing Sheets

(56) References Cited

U.S. PATENT DOCUMENTS

| | | | | |
|---|---|---|---|---|
| 6,591,952 | B1 * | 7/2003 | Randall | A45D 44/02 191/12.4 |
| 6,597,557 | B2 * | 7/2003 | Hunter | A45C 3/02 361/118 |
| 7,168,538 | B2 * | 1/2007 | Pena | H02G 11/02 191/12.2 R |
| 7,210,960 | B2 * | 5/2007 | Mak | H01R 13/504 439/505 |
| 7,497,740 | B2 * | 3/2009 | Mei | H01R 13/514 200/51 R |
| 7,758,376 | B2 * | 7/2010 | Hwang | H01R 13/60 191/12.4 |
| 7,845,974 | B2 * | 12/2010 | Yue | H01R 13/72 191/12.4 |
| 7,874,856 | B1 * | 1/2011 | Schriefer | H01R 13/514 439/214 |
| 8,376,782 | B2 * | 2/2013 | Govekar | H01R 25/006 439/502 |
| 8,544,623 | B1 * | 10/2013 | Murphy | H02G 11/02 191/12.4 |
| 8,905,780 | B2 * | 12/2014 | Vallon | H01R 13/72 439/501 |
| 8,975,790 | B2 * | 3/2015 | Donaldson | H02M 1/12 307/149 |
| 2014/0120765 | A1 * | 5/2014 | Lombardo | H01R 9/2408 439/501 |

OTHER PUBLICATIONS

Wikipedia: “Mehrfachsteckdose,” downloaded Nov. 22, 2013.

* cited by examiner

DISTRIBUTOR HAVING A POWER CONNECTION WITH A PLUG

CROSS REFERENCE TO RELATED APPLICATIONS

This application is the National Stage of PCT/AT2012/050073 filed on May 16, 2012, which claims priority under 35 U.S.C. §119 of Austrian Application No. GM 305/2011 filed on May 26, 2011, the disclosure of which is incorporated by reference. The international application under PCT article 21(2) was not published in English.

FIELD OF THE INVENTION

The invention relates to a distributor, comprising a power connection having a plug and being connected to at least two socket connectors via an electric conductor.

DESCRIPTION OF THE PRIOR ART

Such sockets, which are usually known as distributors, comprise insertion recesses in a base body with standardized sockets for the phase and the neutral conductor as well as bracket contacts for the protective ground conductor, with which several electric consumers are connectable to a socket. The known distributors usually concern elongated distributor units or distributors with a circular cross-section in which the sockets are arranged, wherein the distributor can be supplied with electrical power from a socket by means of a connecting cable with a plug which leads out of said distributor and which is connected to the sockets.

As a result of the continually rising number of electrical devices to be supplied, several sockets are even often required for one single workplace, which is why it has already been proposed (DE 100 37 179 B4) to assign separate housings to the individual socket connectors, which are connected to each other via a link joint and are arranged to be pivotable with respect to each other in a defined range about an axis perpendicular to the direction of insertion, so that a type of ring structure can be formed with the distributor. This produces a multiple socket distributor, which enables the insertion of the individual plugs into the distributor in a covered position, so that in the operating state only one housing is visible from which the inserted cables and the power supply of the distributor protrude through a cable duct provided circumferentially. All the known distributors come with the disadvantage that they merely offer a limited number of socket connectors which are arranged in a common housing, thus leading to limitations not only with respect to the number of the available socket connectors but also with respect to the connection length of the distributor. If it is necessary to provide further socket connectors or if it is necessary to provide further extension to subsequent socket connectors after providing a socket connector, several distributors would have to be connected successively, thus leading to a loss of socket outlets in the distributors and to a large number of multiple socket distributors.

SUMMARY OF THE INVENTION

Based on a state of the art of the kind mentioned above, the invention is based on the object of providing a distributor, which by using simple means allows the supply of several electric appliances which are evenly arranged at a larger distance from each other without having to use a plurality of distributors.

This object is achieved by the invention in such a way that the socket connectors are associated with separate sockets which can be detachably interconnected or detachably connected to a housing and which are each connected one to the other or to the housing by one respective extension lead.

Since the individual sockets are interconnected by means of extension leads, larger distances between the individual electric consumers can be bridged easily and it is therefore possible to supply a large number of electric consumers in rooms with a low number of sockets without having to provide a plurality of distributors. This is especially advantageous for construction sites, for supplying several kitchen appliances, in old buildings or the like. The individual socket connectors are arranged on the extension lead in the manner of a chain of lights and can thus easily be arranged in a distributed fashion over any desirable space. It is obvious that the plugs and sockets can be arranged in a large variety of manners with respect to the different national specifications. In addition to the multiple power distributor, a multiple-data, audio and/or video or optical waveguide distributor can be arranged in accordance with the invention in order to allow utilizing the advantages in accordance with the invention in other ways. At the same time, it is possible to provide the distributor for cable combinations for power and data supply. The sockets can also be inserted into separate socket housings which can be interconnected or detachably connected to a housing.

In order to enable the supply of several devices at one location with electrical power—as is common practice with a distributor—, each socket can form a module comprising at least two socket connectors. In this case, the individual modules are interconnected via extension leads and it is not necessary to stow an excessive number of connecting or extension leads when several sockets need to be used close to one another from a spatial standpoint.

In order to prevent an unnecessary tangle of cables between the individual sockets, it is recommended that the sockets are interconnected via spiral extension leads which hold the extension leads between the individual sockets at all times in a pretensioned manner and therefore give a neat impression at all times.

For the purpose of simplified storage or in order to enable the use of the distributor in accordance with the invention as a conventional distributor with socket connectors arranged in a base body, it is recommended that a common housing is provided for the sockets and the extension leads, wherein the housing forms receptacles in which the sockets can be inserted in a removable fashion. In this case, the housing can also provide stowage space for the extension leads.

In order to neatly store the extension leads during non-use of the distributor, it is proposed that the socket is associated with a cable drum which is preferably arranged in its housing. Especially neat conditions are obtained when the cable drums are rotatably mounted in the housing or on the housing, and are subject to spring tension in the winding-up sense. A winding-up function can be provided as is known from shutters, cable drums of vacuum cleaners for example or the like.

The detachable connection between the housings of the sockets is preferably achieved by latching means, with which socket housings can be latched among each other. The socket housings could also alternatively be connected in the manner of a bayonet catch.

BRIEF DESCRIPTION OF THE DRAWINGS

The invention is schematically shown in closer detail by reference to the drawings, wherein.

DESCRIPTION OF THE PREFERRED EMBODIMENT

Figure 2:
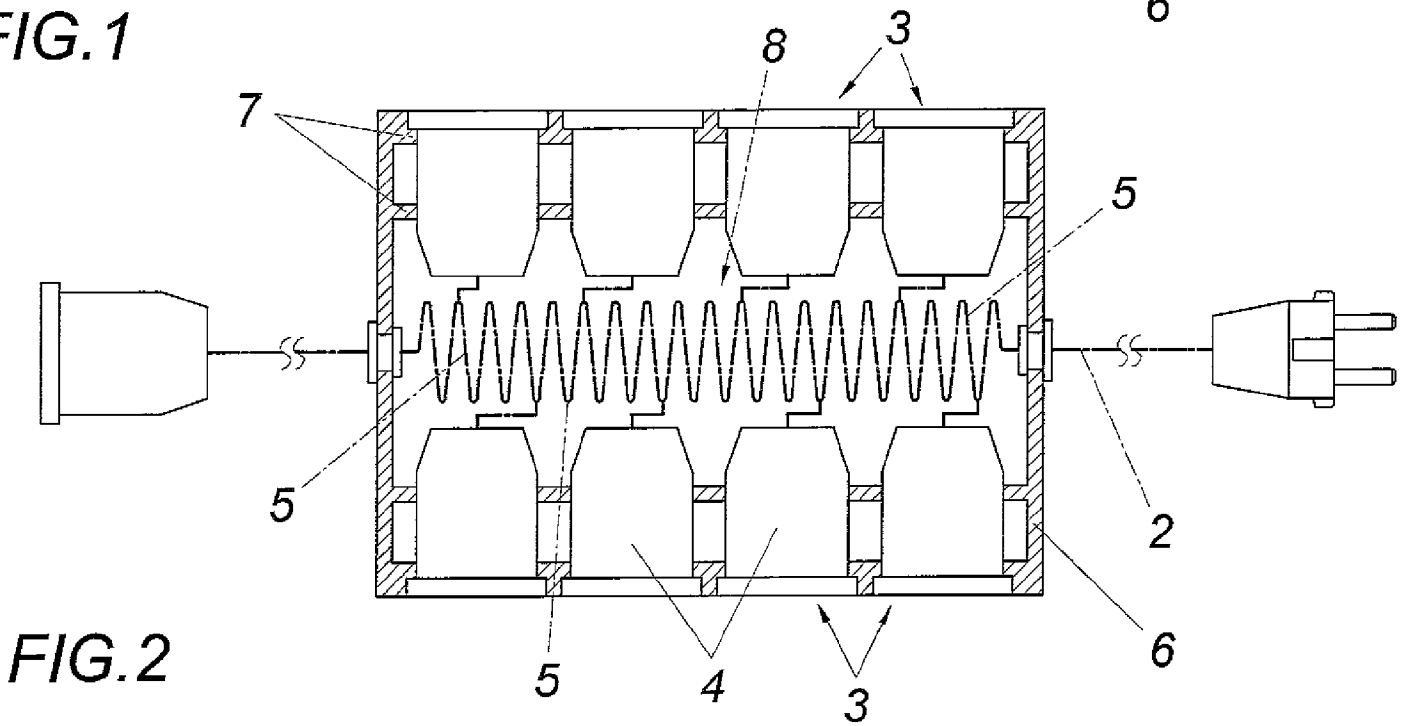
FIG. 2 shows the distributor of FIG. 1 in a partial sectional top view along the line II-II of FIG. 1.
Figure 3:
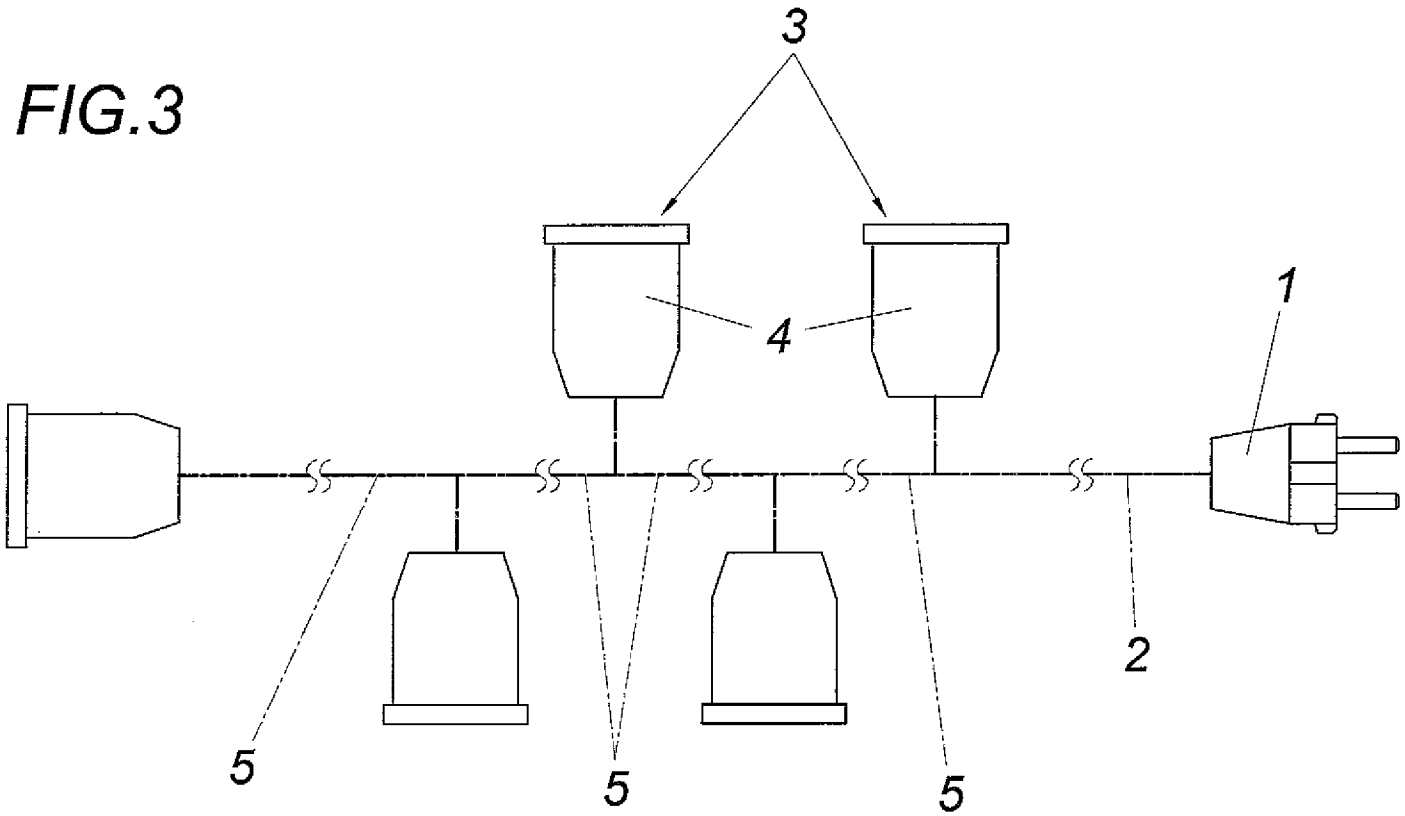
FIG. 3 shows the distributor of FIGS. 1 and 2 with socket connectors removed from the distributor housing and extension cables.

A distributor comprises a power connection having a plug 1, which is connected via a current conductor 2 to several socket connectors 3. In order to be variable and flexible concerning the distributor length and the locations of use for the individual socket connectors 3, the socket connectors 3 are respectively associated with one separate socket 4, and the sockets 4 are interconnected via extension leads 5. FIG. 2 indicates that the sockets 4 are interconnected via spiral extension leads 5. The socket connectors 3 belong to separate sockets 4 which are interconnected via extension leads 5. Furthermore, the socket housings 9 are detachably connected to each other, wherein even more than one socket connector 3 can be provided for each socket housing 9.

Figure 1:
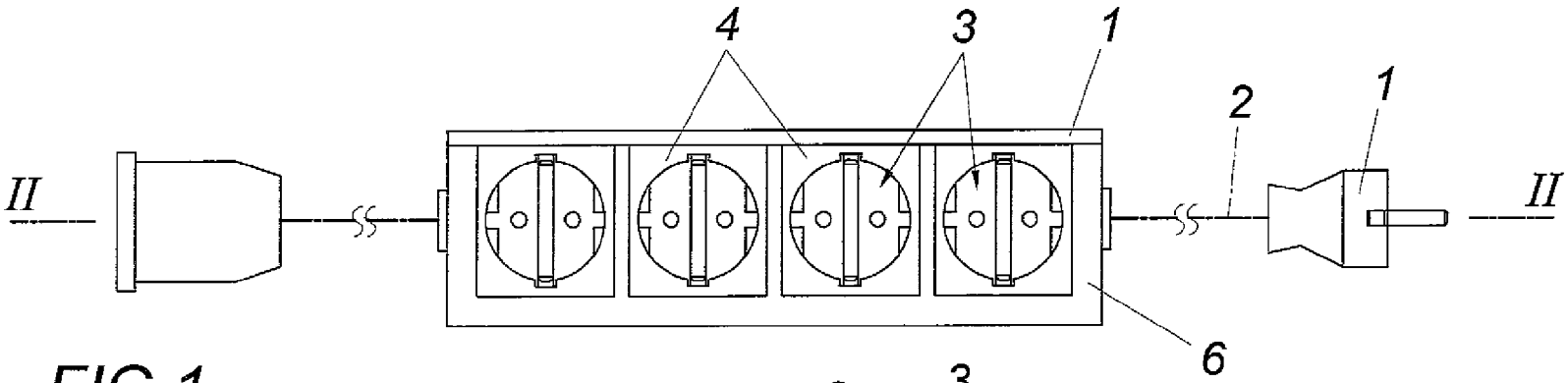
FIG. 1 shows a side view of a distributor in accordance with the invention.

Furthermore, a common housing 6 is provided for the sockets 4 and for the extension leads 5, which housing 6 forms receptacles 7 into which the sockets 4 are removably insertable, e.g. in the manner of a snap-in connection (FIGS. 1 and 2). As is indicated in FIG. 1, a detachable cover for the housing 6 can also be provided for this purpose, after the removal of which from the housing 6 either the entire extension lead 5 plus the sockets 4 can be taken from the housing 6, or merely individual sections of cables distributors as required. Furthermore, the housing 6 forms a stowage space 8 for the extension lead 5 between two rows of sockets.

Figure 5:
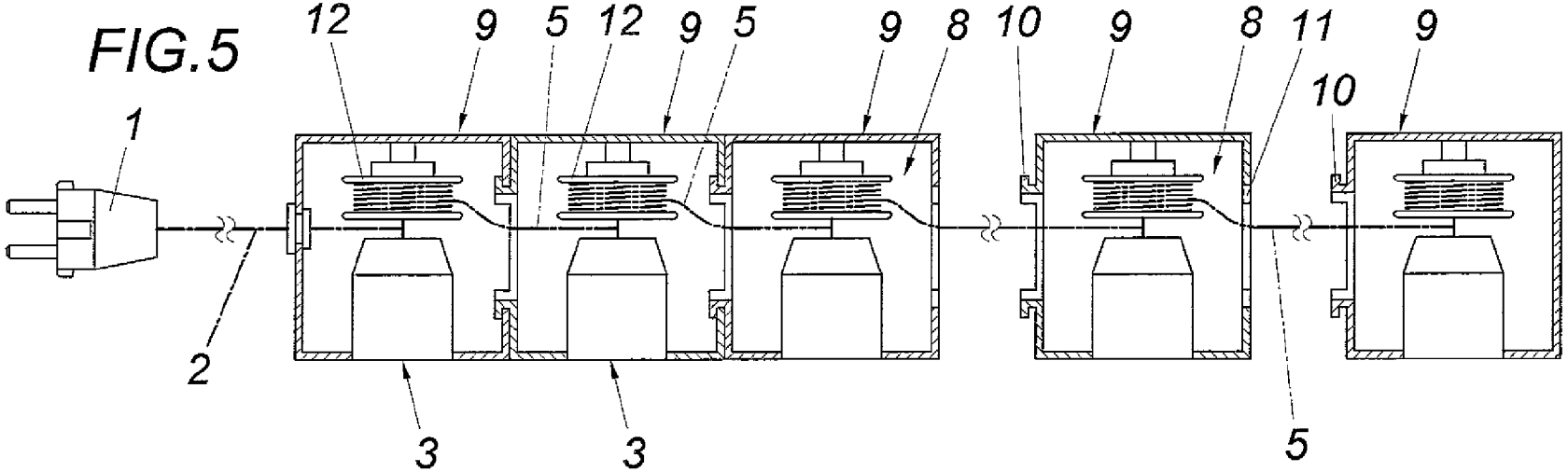
FIG. 5 shows the distributor of FIG. 4 in a partly sectional side view.
Figure 4:
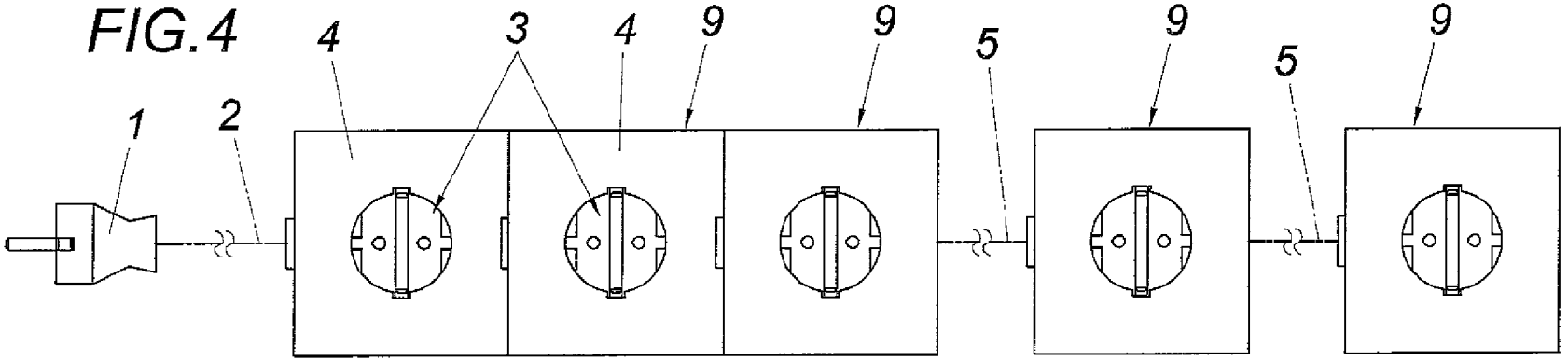
FIG. 4 shows a top view of a constructional variant of a distributor in accordance with the invention.

In the embodiment according to FIGS. 4 and 5, the socket housings 9 can be connected to each other in the manner of a bayonet catch. For this purpose, protrusions 10 are provided on one side of the socket housing, which protrusions are insertable into a respective recess 11 of the opposite socket housing part. Furthermore, cable drums 12 are rotatably mounted in the socket housings 9, which cable drums are under spring tension in the winding-up sense. A conventional winding mechanism of such cable drums is not shown in closer detail.

Figure 6:
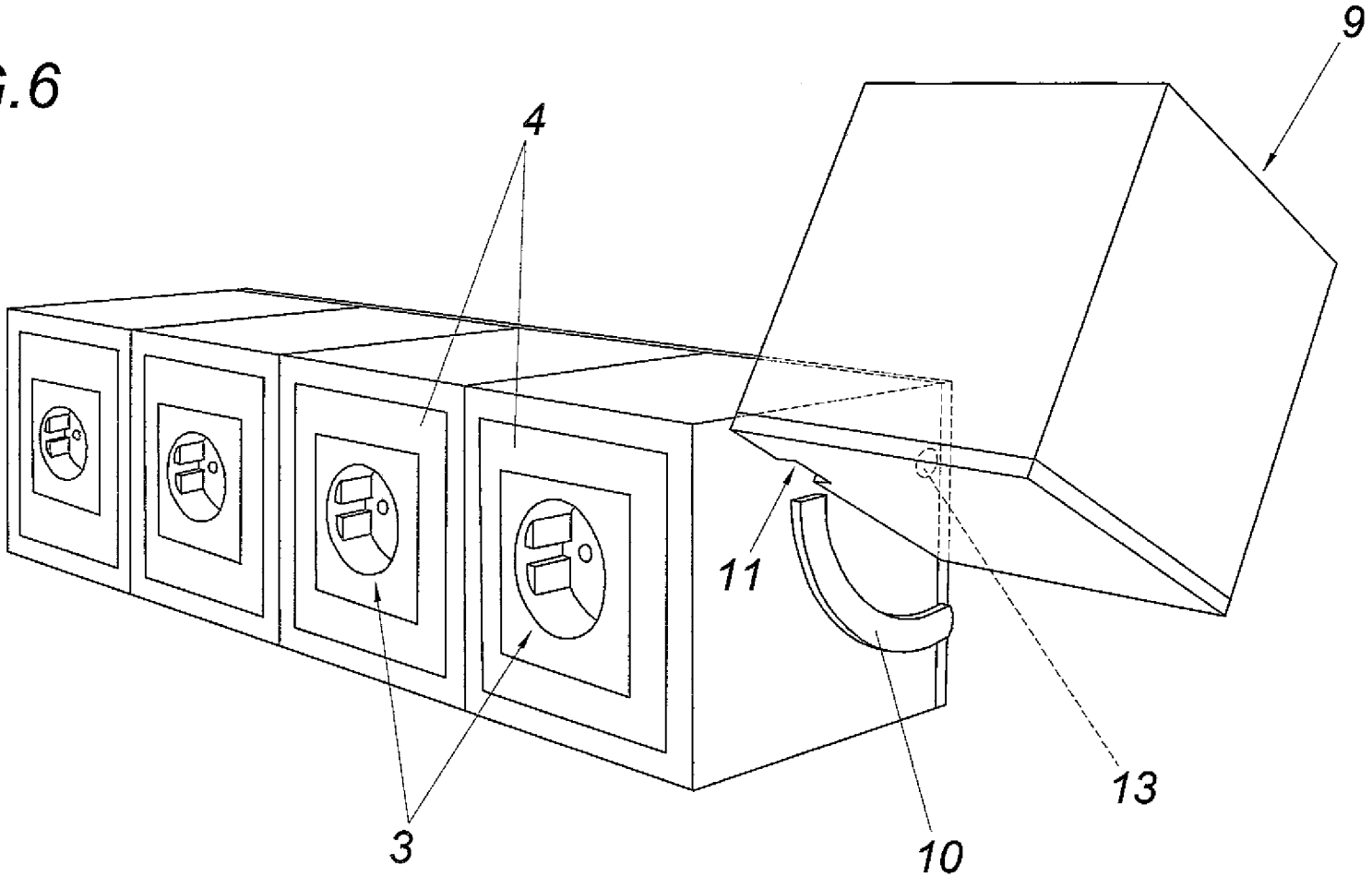
FIG. 6 shows a constructional variant of the distributor of FIGS. 4 and 5 in an oblique view.

In the embodiment according to FIG. 6, the socket housings 9 can be interconnected in the manner of a bayonet catch, for which purpose the housing is pivotable about a cable guide opening 13 or its axis. The bayonet catch comprises on its part a protrusion 10 and a recess 11 which are provided on opposite housing surfaces. After detaching the connection between adjacent socket housings 9 by respective pivoting (see FIG. 6), the mutually adjacent socket housings 9 can be pulled apart. The socket housings 9 are again interconnected via extension leads 5, which can be wound up on a cable drum 12 integrated in the socket housing 9.

Figure 7:
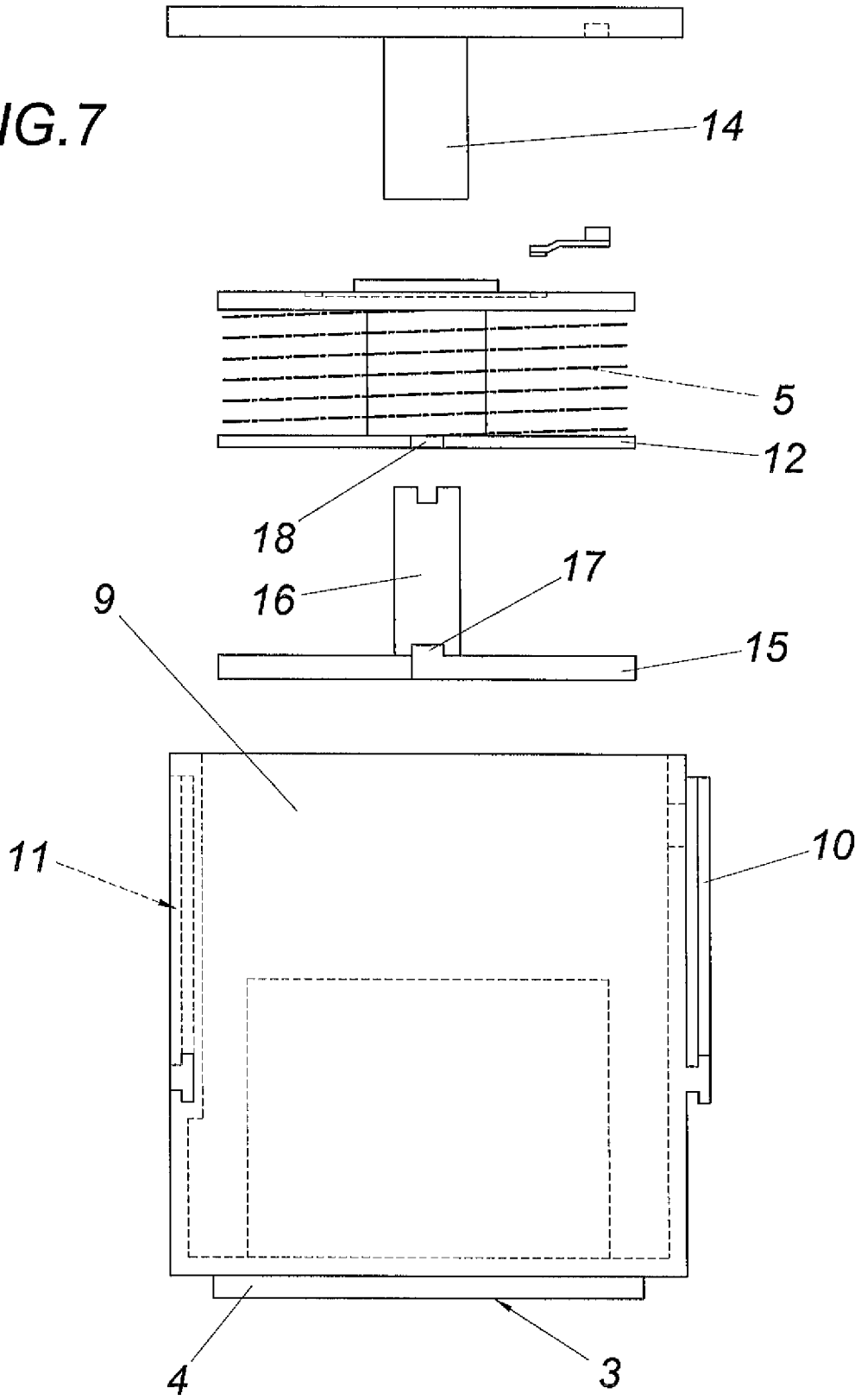
FIG. 7 shows a socket housing of FIG. 6 in a schematic exploded view.

The arrangement of such a cable drum 12 which can be wound up against spring action is schematically shown in FIG. 7. For this purpose, the cable drum 12 which accommodates the extension cable 5 is rotatably mounted on a spindle 14 facing the rear housing wall. The spring 15, which is a spiral spring, is fixed to a pin 16 which is inserted in a torsion-proof manner into the spindle 14. At the other end, the spring is connected via a protrusion 17 to a recess 18 on the cable drum 12. Furthermore, a brake or a latching apparatus, which is not shown in closer detail, can be provided with which the extension length of the extension cable can be determined.

Figure 8:
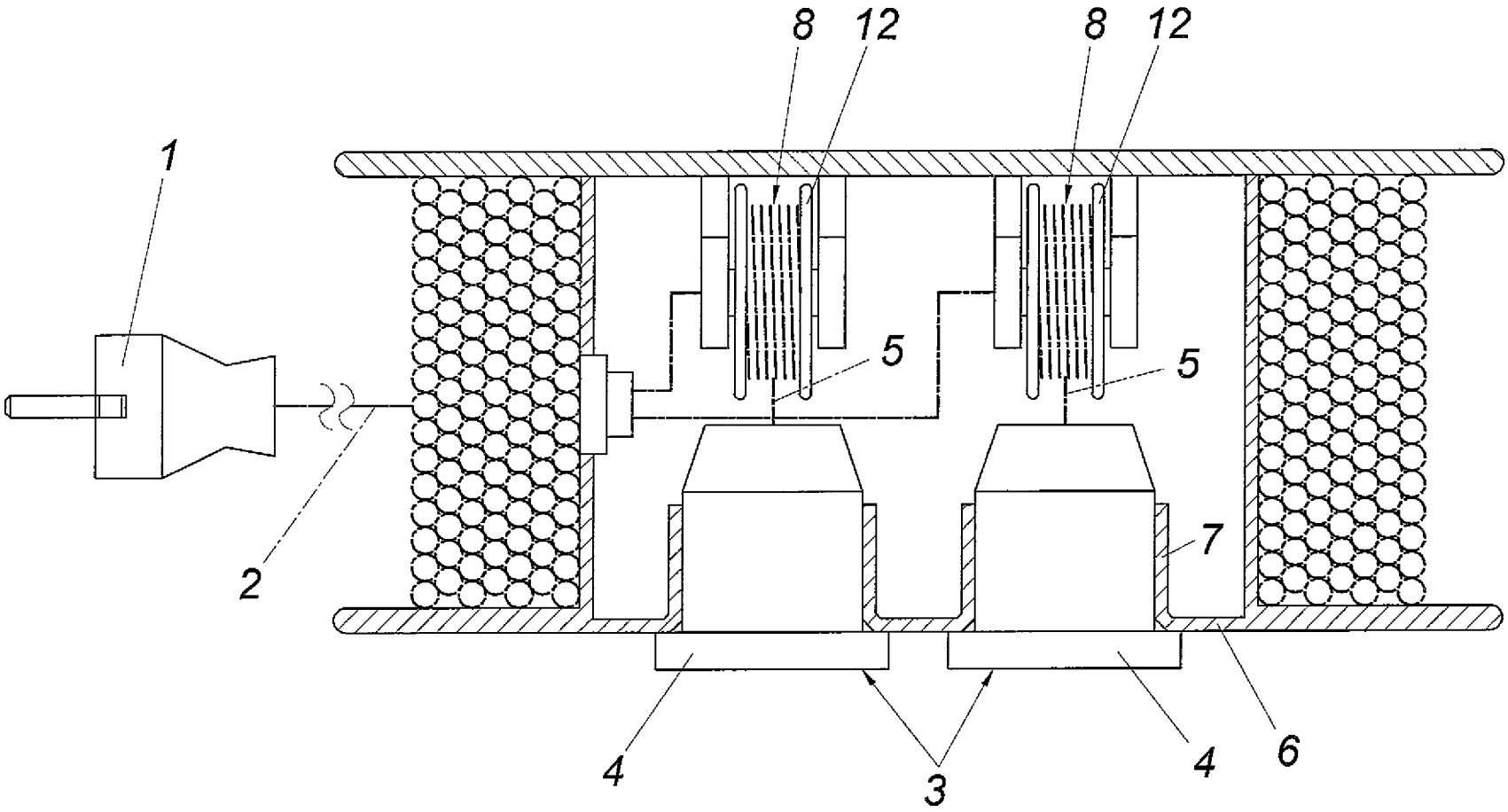
FIG. 8 shows a partly sectional cross-sectional view of a further constructional variant of a distributor with a housing arranged as a cable drum.
Figure 9:
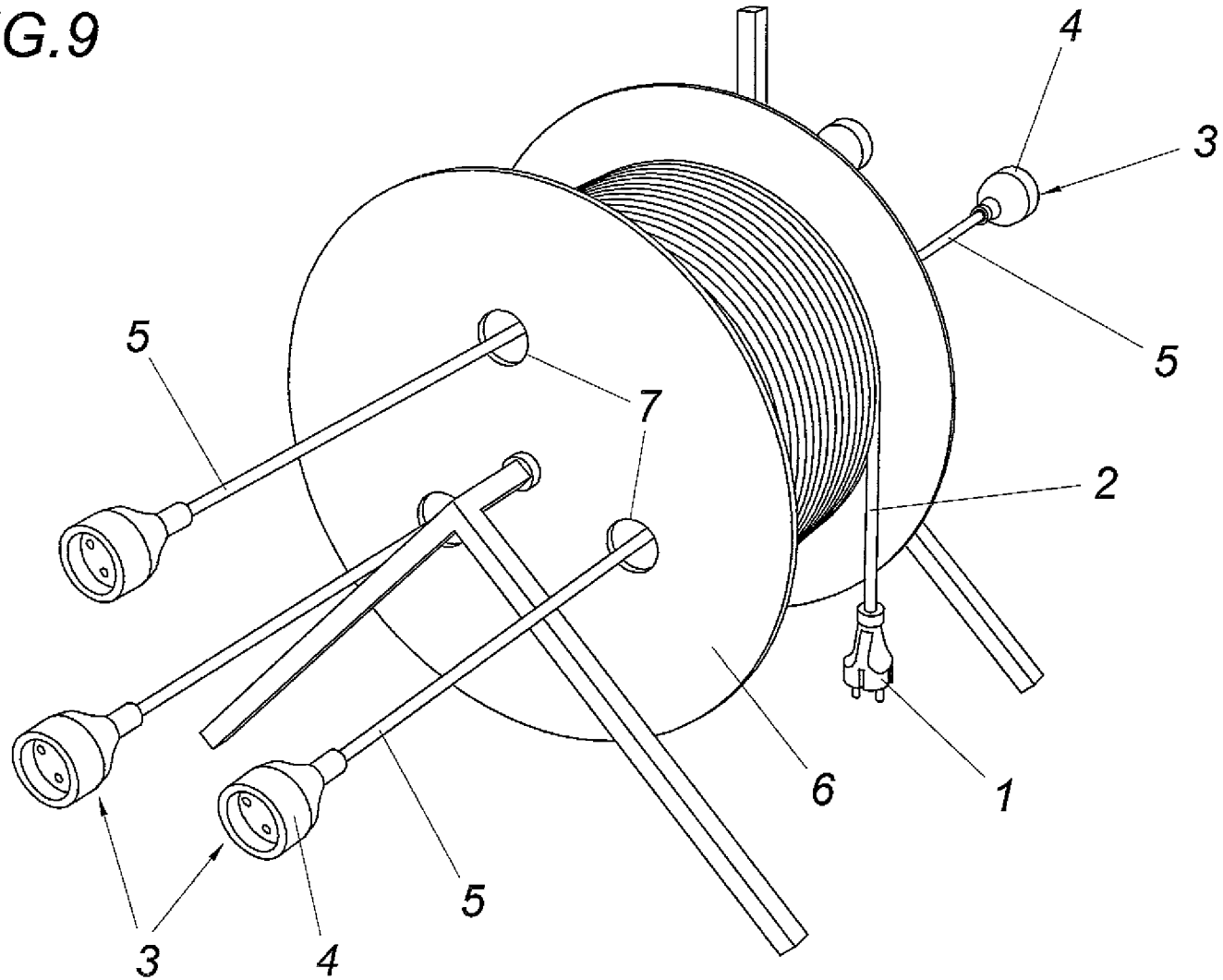
FIG. 9 shows a constructional variant of the distributor of FIG. 8 in an oblique view.

In the embodiments according to FIGS. 8 and 9, the sockets 4 are interconnected via extension cables 5 in such a way that they are inserted into a common housing 6 which is arranged as a cable drum. Cable drums 12 for the extension cables 5 are again provided in the housing 6. Similarly, socket housings 9 in the manner as provided in FIGS. 4 to 7 can be inserted into the housing 6 instead of the sockets 4. The cable drums would then have to be housed selectively either in the housing 6 or in the socket housings 9. In the example according to FIG. 9, the sockets 4 can be drawn off with the extension cables 5 from both face ends of the cable drum.

The invention claimed is:

1. A distributor, comprising a power connection having a plug and being connected to at least two socket connectors via an electric conductor, wherein the socket connectors are associated with separate sockets which can be detachably interconnected or detachably connected to a housing and which are each connected one to the other or to the housing by an extension lead, wherein a common housing is provided for the sockets and the extension leads, wherein the housing forms receptacles and the sockets can be removably inserted in the receptacles, and wherein the housing is arranged itself as a cable drum.

2. The distributor according to claim 1, wherein the sockets are detachably interconnected or detachably connected to the housing via spiral extension leads.

3. The distributor according to claim 1, wherein the housing forms a stowage space for an extension cable.

4. The distributor according to claim 1, wherein each socket is associated with a cable drum arranged in the socket housing.

5. The distributor according to claim 4, wherein the cable drums are under spring tension in the winding-up sense.

6. A distributor, comprising a power connection having a plug and being connected to at least two socket connectors via an electric conductor, wherein the socket connectors are associated with separate sockets which can be detachably interconnected or detachably connected to a housing and which are each connected one to the other or to the housing by an extension lead, wherein each socket comprises a socket housing comprising at least one of a curved protrusion and a curved opening, wherein the socket housings are detachably interconnected in the manner of a bayonet catch in that the curved protrusion of a first socket housing engages into the curved opening of a second socket housing during a pivoting movement of the first socket housing or of the second socket housing.

7. A distributor, comprising a power connection having a plug and being connected to at least two socket connectors via an electric conductor, wherein the socket connectors are associated with separate sockets which can be detachably interconnected or detachably connected to a housing and which are each connected one to the other or to the housing by an extension lead, wherein each socket comprises a socket housing comprising at least one of a protrusion and a recess, wherein the socket housings are detachably interconnected in the manner of a bayonet catch in that the protrusion of a first socket housing engages into the recess of a second socket housing, and wherein the extension lead extends through the recess of the second socket housing to connect the socket of the first socket housing to the socket of the second socket housing.

* * * * *